US006443046B1

(12) United States Patent
Deininger et al.

(10) Patent No.: US 6,443,046 B1
(45) Date of Patent: Sep. 3, 2002

(54) METHOD OF CONTROLLING A LONG-STROKE, HYDRAULIC OPERATING CYLINDER

(75) Inventors: Friedrich Deininger, Linz; Johann Oberhumer, Unterweitersdorf; Werner Rab, Linz, all of (AT)

(73) Assignee: Voest-Alpine Industrieanlagenbau GmbH, Linz (AT)

( * ) Notice: Subject to any disclaimer, the term of this patent is extended or adjusted under 35 U.S.C. 154(b) by 0 days.

(21) Appl. No.: 09/515,530

(22) Filed: Feb. 29, 2000

(30) Foreign Application Priority Data

Mar. 1, 1999 (AT) ..... 332/99

(51) Int. Cl.[7] ..... F15B 13/16
(52) U.S. Cl. ..... 91/358 R; 60/329; 72/10.6
(58) Field of Search ..... 60/329; 91/358 R, 91/361, 388; 72/10.6

(56) References Cited

U.S. PATENT DOCUMENTS 4,358,989 A * 11/1982 Tordenmalm ..... 91/361
4,817,407 A * 4/1989 Alich ..... 72/10.6
4,909,060 A * 3/1990 Jaquay ..... 91/361

FOREIGN PATENT DOCUMENTS

DE 39 39 124 5/1991

* cited by examiner

*Primary Examiner*—F. Daniel Lopez
(74) *Attorney, Agent, or Firm*—Collard & Roe, P.C.

(57) ABSTRACT

There is described a method of controlling a long-stroke, hydraulic operating cylinder (1), in particular a screw-down cylinder for an edging stand, where the piston (4), to which a load can be applied at both ends, and which can be locked hydraulically along its stroke (s) in various working positions, is abruptly loaded with an external force after it has been locked. To create advantageous method conditions, it is proposed that the piston (4) be locked under a hydraulic pressure chosen in dependence on the respective working position, which hydraulic pressure decreases along the stroke (s) against the direction of action of the external force.

2 Claims, 3 Drawing Sheets locking pressure
[bar]

displacement under impact force
[mm]
250
225
200
175
150
125
100
75
50
25
0
3
2,75
2,5
2,25
2
1,75
1,5
1,25
1
0,75
0,5
0,25
$s_V$
$p_V$
0
200
400
600
800
s[mm]

s[mm]

p[bar]
W
$p_{V2}$
s
$p_V$
$p_{V1}$
408
407
406
405
404
300
250
200
150
100
50
0
0.1
0.2
0.3
0.4
t[s]

METHOD OF CONTROLLING A LONG-STROKE, HYDRAULIC OPERATING CYLINDER

FIELD OF THE INVENTION

This invention relates to a method of controlling a long-stroke, hydraulic operating cylinder, in particular a screw-down cylinder for an edging stand, wherein the piston, to which a load can be applied at both ends, and which can be locked hydraulically along its stroke in various working positions, is abruptly loaded with an external force after it has been locked.

DESCRIPTION OF THE PRIOR ART

Long-stroke hydraulic cylinders, as they are in particular used for adjusting the roll gap of edging stands, are locked in the respective working position chosen along the piston stroke. When the pistons are abruptly subjected to a load, for instance due to an increase in the rolling force immediately after the initial pass, a piston displacement occurs despite such locking due to the compressibility of the hydraulic medium and the elastic behavior of the construction parts carrying the hydraulic medium. A control provided for actuating the respective working position and tracking the pistons under changing conditions can only operate with its own control delay, so that in the case of an abrupt load acting on the pistons a short-time yielding of the operating cylinder must be expected, which leads to difficulties in the case of higher demands as to the accuracy of the maintenance of the respective working position.

SUMMARY OF THE INVENTION

It is therefore the object underlying the invention to provide a method of controlling a long-stroke, hydraulic operating cylinder, in particular a screw-down cylinder for an edging stand as described above such that the displacement of the hydraulically locked piston can be restricted to a comparatively small degree in the case of an abrupt load acting on the piston.

This object is solved by the invention in that the piston is locked under a hydraulic pressure chosen in dependence on the respective working position, which hydraulic pressure decreases along the stroke against the direction of action of the external force.

The invention is based on the knowledge that in a working position of the piston with a comparatively small cylinder volume, the pressure of the hydraulic medium at the end of the piston exposed to a relief in the case of an external impact load is decreased much faster at this end during a piston displacement due to the comparatively low volume than the pressure of the hydraulic medium is increased at the opposite end of the piston in the vicinity of the larger volume of hydraulic medium. When the external impact load of the piston occurs, however, in a working position with a comparatively large cylinder volume at the end of the piston relieved during an impact load, there is a faster increase in pressure in the vicinity of the comparatively low volume of the hydraulic medium at the opposite end of the piston, whereas the pressure of the hydraulic medium in the vicinity of the larger cylinder volume at the other end of the piston is decreased at a correspondingly lower rate. In the case of a working position with a piston displaced towards the end of the stroke against the direction of impact, this means a comparatively large piston displacement during the impact load, whereas this impact-related displacement at the opposite end of the stroke remains comparatively small due to the quickly increasing counterpressure.

In order to limit the impact-related piston displacement, a corresponding counterpressure must be ensured by means of the hydraulic medium without having to fear an overload of the cylinder due to the impact-related increase in pressure. From these requirements it follows that to limit the impact-related piston displacements, the pressure of the hydraulic medium, at which the piston is locked in the respective working position, should decrease along the stroke against the direction of action of the external force acting on the piston. The piston can thus be locked in the end portion of the stroke facing the impact load with the maximum pressure of the hydraulic medium, because the increase in pressure occurring during an external impact load remains limited. Due to the high increase in pressure in the case of an abrupt load acting on the piston which is locked in the vicinity of the opposite stroke end, the locking pressure must be chosen correspondingly low, so as not to endanger the cylinder at the one end of the piston due to the increase in the pressure of the hydraulic medium caused by the influence of the external force. The piston displacement nevertheless remains small because of the quickly increasing counterforce. Since the piston is locked under a locking pressure that depends on the respective working position of the piston along its stroke, the impact-related piston displacement can thus be restricted to a degree that is admissible for most applications without any additional measures.

To be able to lock the piston in the respective working position under a hydraulic pressure provided for this position, the piston can already be subjected to the locking pressure provided for this working position when it approaches such working position, so that in cooperation with the position control, a corresponding counterpressure must build up, when the piston should firmly be held in the respective working position.

BRIEF DESCRIPTION OF THE DRAWING

The method in accordance with the invention will now be explained in detail with reference to the drawing, wherein.

DESCRIPTION OF THE PREFERRED EMBODIMENTS

Figure 1:
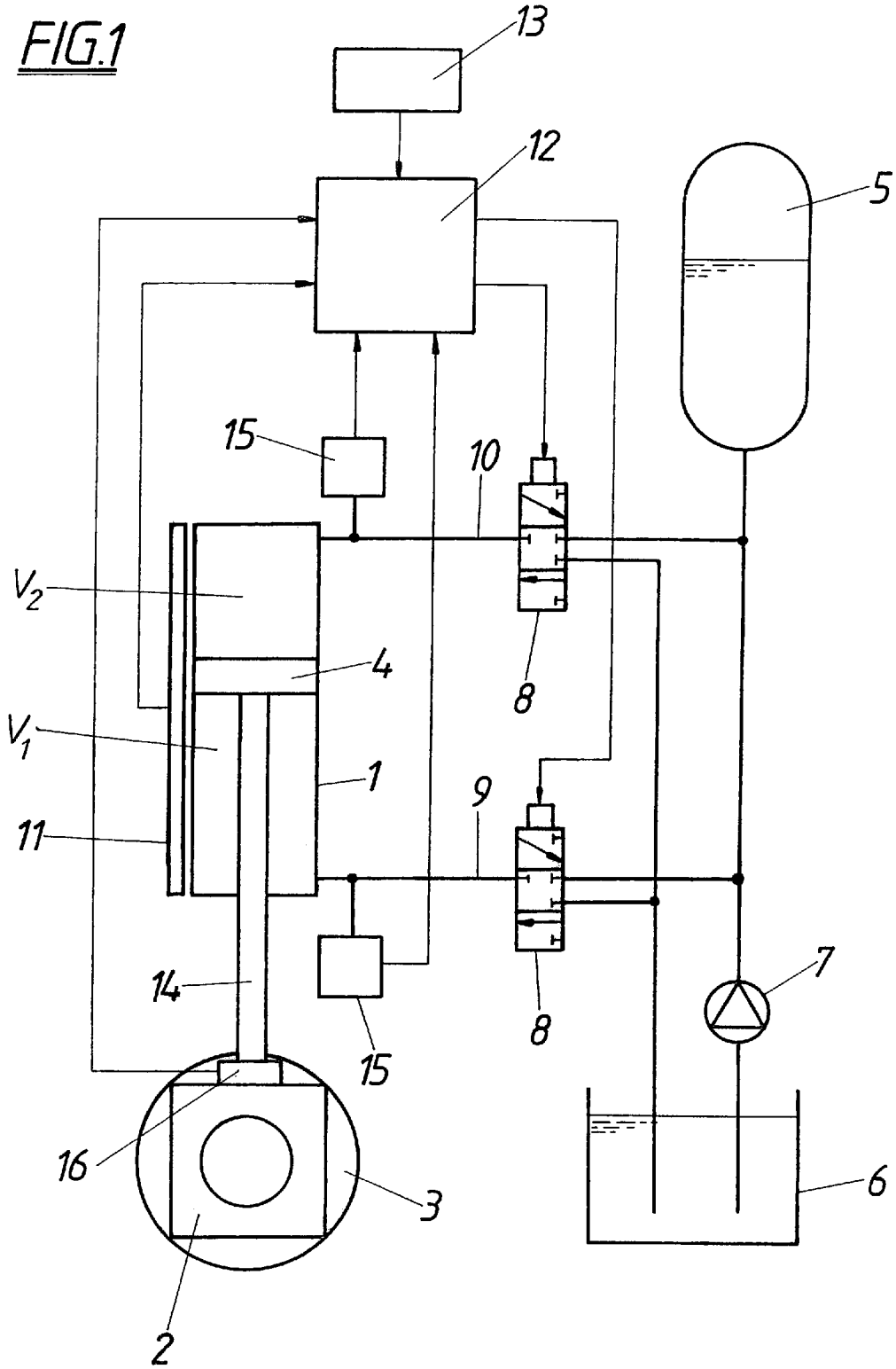
FIG. 1 shows a screw-down cylinder for an edging stand, which can be controlled in accordance with the inventive method, in a schematic block circuit diagram.

In accordance with the embodiment shown in FIG. 1, the roll gap of an edging stand is adjusted by means of hydraulic operating cylinders 1, which act on the chocks 2 for supporting the edging roll 3 at the end. For this purpose, a load can be applied at both ends of the pistons 4 of the operating cylinders 1 via an accumulator 5, which is charged via a pump 7 connected to a container 6 of hydraulic medium. Applying a load onto the pistons 4 is effected via multiway valves 8, which are incorporated in the connecting lines 9 and 10 of the operating cylinders 1. Since the respective position of the pistons 4 is detected via a position sensor 11 and forwarded to a control means 12, into which the working position of the pistons 4 to be approached can be entered via an input 13, the valves 8 can be actuated via the control means 12 such that the pistons 4 take the respective working position in which they are hydraulically locked via the valves 8, as is indicated in FIG. 1.

Figure 2:
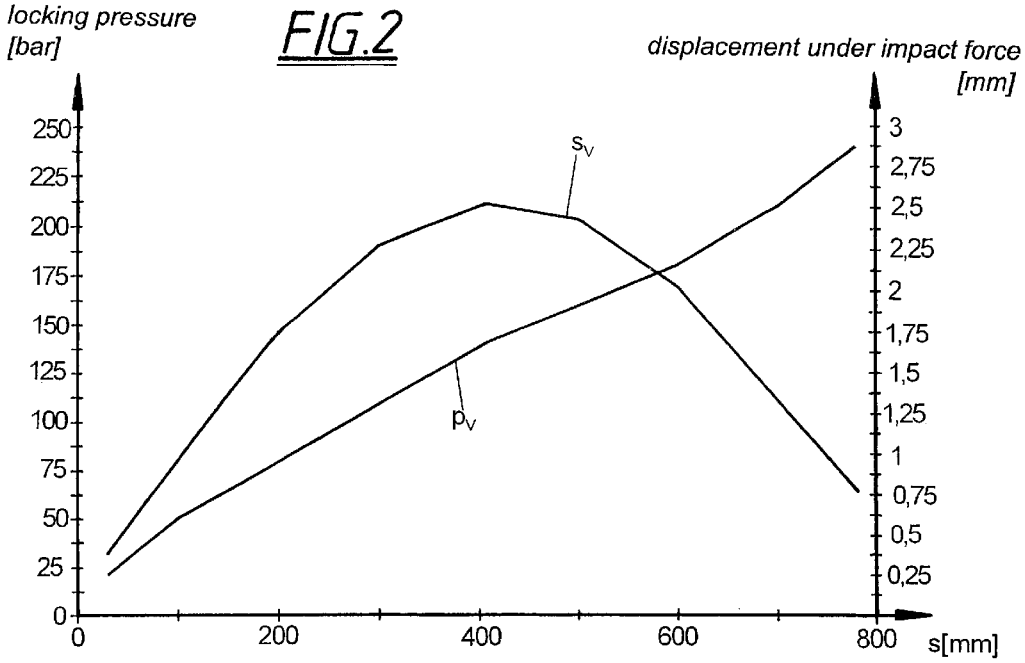
FIG. 2 shows the course of the locking pressure and the impact-related piston displacement, which is restricted due to this locking pressure, along the stroke.

In accordance with FIG. 2, the locking pressure $p_v$ should increase along the stroke $s_1$ where the lowest locking pressure $p_v$ is achieved when the piston rod 14 is retracted, and the highest locking pressure $p_v$ is achieved, when the piston rod 14 is extended. Accordingly, the stroke s is counted in FIG. 2 starting from the stop position of the piston 4 for the retracted piston rod 14. In this position of the piston, the hydraulic volume $V_1$, is highest at the piston rod end of the pistons 4. In the opposite stop position of the pistons 4, however, the hydraulic medium volume $V_2$ at the end of the piston opposite the piston rod 14 is at a maximum, whereas the hydraulic medium volume $V_1$ on the side of the piston represents a minimum. This means that in the case of an abrupt load acting on the edging roll 3 due to the initial pass, the pistons 4 are likewise subjected to an abrupt load via the piston rods 14, which due to the compressibility of the hydraulic medium and the elastic properties of the construction parts carrying the hydraulic medium leads to a piston displacement with the characteristic effect for this working position that the pressure in the vicinity of the hydraulic medium volume $V_1$ is decreased very quickly, whereas the pressure in the vicinity of the hydraulic medium volume $V_2$ is built up at a comparatively low rate. When in this area a high locking pressure is chosen, as shown in FIG. 2, a correspondingly high counterpressure can be put up against the impact-related displacement of the pistons 4, which restricts the piston displacment to an admissible degree without overloading the operating cylinders 1. With increasing $V_1$ and decreasing $V_2$ these conditions are changed, however, because with a small $V_2$ a minor displacement of the pistons 4 already causes a high increase in pressure in the vicinity of $V_2$, so that a counterforce acting against the impact load is quickly built up. This counterforce must, however, be restricted due to the limited load-bearing capacity of the operating cylinders 1. In working positions with larger $V_1$ and smaller $V_2$, the pistons 4 can therefore be locked hydraulically under a comparatively low locking pressure $p_v$, as can be taken from FIG. 2.

Figure 3:
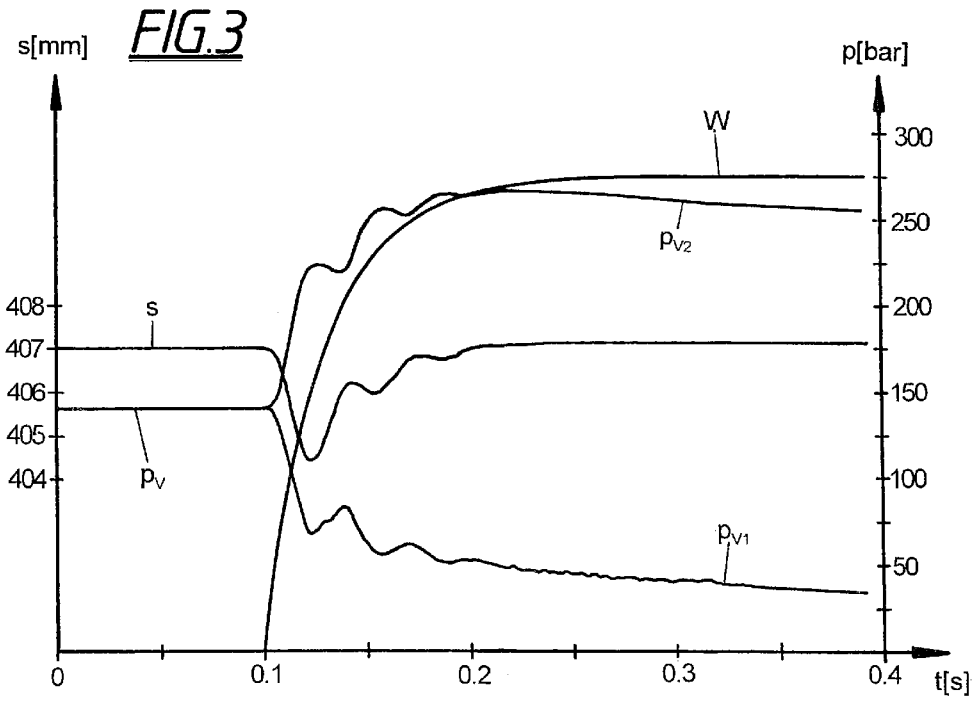
FIG. 3 shows the time characteristic of the position of the piston and the pressure of the hydraulic medium at both ends of the piston.
Figure 4:
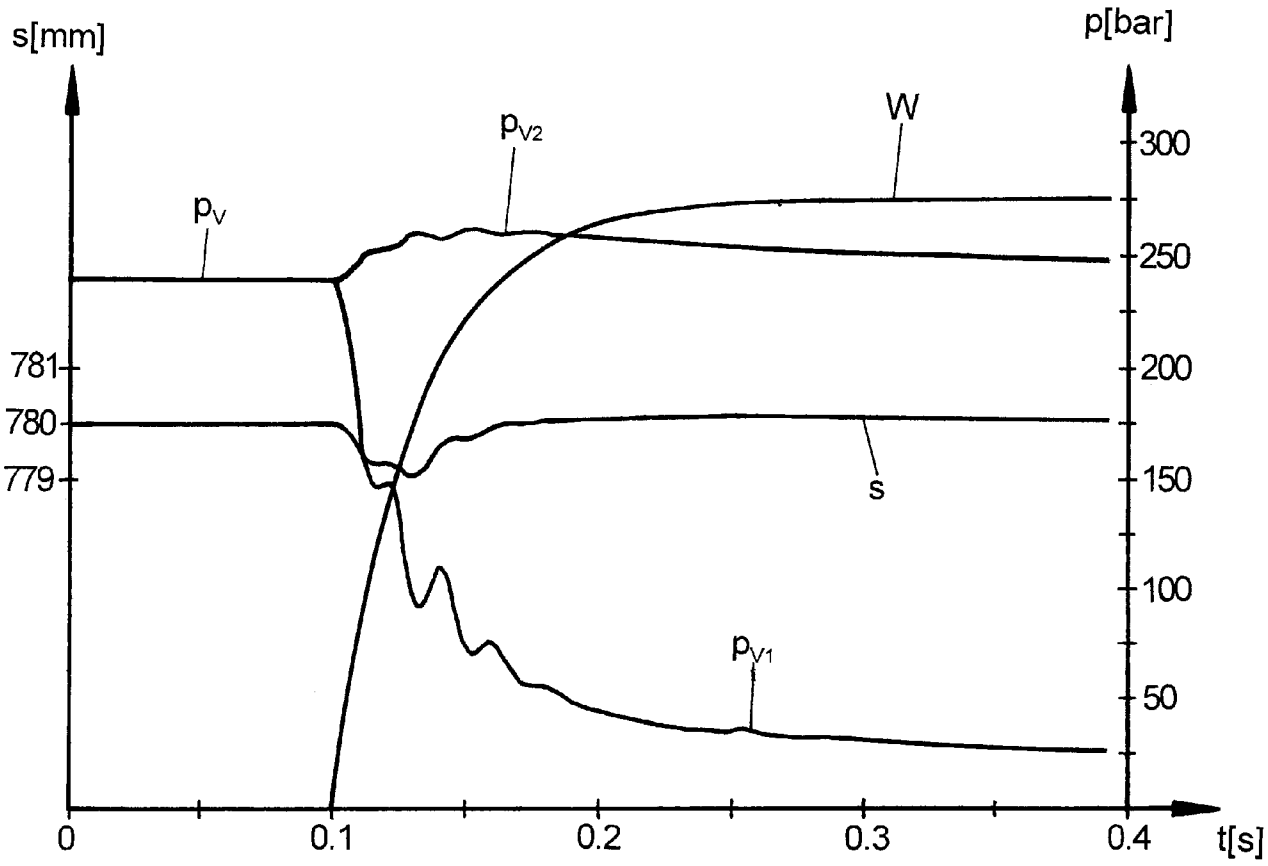
FIG. 4 shows a representation corresponding to FIG. 3, but for a position of the piston in the vicinity of the stroke end facing the impact load.

The conditions obtained in the case of an abrupt increase in the rolling force W are illustrated in FIGS. 3 and 4. Like FIG. 2, these FIGS. 3 and 4 relate to an operating cylinder with a maximum stroke of 800 mm. While FIG. 3 shows a middle working position of the piston with a stroke of 407 mm and an abrupt increase in the rolling force W from 0 to 5500 kN, FIG. 4 represents the conditions for a working position of the piston for the stroke s=780 mm with the same increase in rolling force. In accordance with FIG. 2, the locking pressure $p_v$ was chosen to be 140 bar for the middle working position. FIG. 3 illustrates that the pressure $p_{v1}$ in the vicinity of the volume $V_1$ decreases to about 50 bar within 0.1 sec, whereas the pressure $p_{v2}$ at the opposite end of the piston increases to about 265 bar. The piston is displaced by 2.5 mm during a period of about 0.05 sec. In the extended position of the piston as shown in FIG. 4, a considerably higher locking pressure of 240 bar can be chosen, because the pressure at the end of the piston facing away from the piston rod only slightly increases to about 265 bar. The pressure $P_{v1}$ strongly decreases, however, with a minor piston displacement of 1 mm.

In FIG. 2, the piston displacements $s_v$ obtained when using the method in accordance with the invention are plotted along the stroke s. Hence it follows that in the vicinity of the middle working position a maximum displacement $s_v$ in the range of 2.5 mm must be expected, whereas these displacements $s_v$ decrease correspondingly towards the ends. In the case of a hydraulic locking of the piston in accordance with the prior art, piston displacements of around ten times these values should be be expected.

To be able to easily lock the pistons 4 unter the predetermined locking pressure $p_v$, which depends on the working position of the pistons 4, the predetermined locking pressure $p_v$ is applied onto the pistons 4 on the side of the piston rod via the valve 8 in the connecting line 9, as shown in FIG. 1, whereas at the opposite end of the piston the pressure to be applied is chosen via the associated valve 8 in the connecting line 10 such that the pistons 4 are moved into the intended working position, which is detected by the position sensor 11. Since the pressure on the side of the piston rod corresponds to the chosen pressure $p_v$ to be applied, which is monitored via a pressure sensor 15, the pressure $P_v$ to be applied at the end of the piston opposite the piston rod 14 must correspond to the locking pressure upon reaching the working position, when a displacement of the pistons 4 is not admitted. When the hydraulic ports 9 and 10 of the operating cylinders 1 are blocked under these conditions via the valves 8, the pistons 4 are hydraulically locked under the respectively chosen locking pressure $p_v$. It need probably not be emphasized particularly that the chosen working position of the pistons 4 can first be approached before the required pressure $p_v$ to be applied is adjusted, under which the pistons 4 should be locked. It is merely important that there is ensured a locking pressure $p_v$, which depends on the stroke s, in order to ensure the maximum counterforce for the abruptly occurring rolling force, which is adapted to the admissible cylinder load.

Via the control means 12, changing conditions in the vicinity of the roll gap can of course also be taken into account. For this purpose, the load applied onto the piston is detected via the edging roll 3 for instance by means of a pressure cell 16, so that this applied force can be used as reference variable for the operating cylinders 1. But since piston displacements as a result of abrupt loads acting on the pistons cannot be processed by the control in time due to its own inevitable control delays, the pistons 4 are locked hydraulically with a locking pressure $p_v$, which depends on the stroke s of the operating cylinders 1.

What is claimed is:

1. A method of controlling a long-stroke, double-acting hydraulic operating cylinder having a piston accomplishing work in both directions by admitting hydraulic fluid alternately to cylinder chambers at opposite ends of the cylinder and being capable of being hydraulically locked along the piston stroke in various working positions and of being subjected to an abrupt external force after it has been locked, which comprises the step of hydraulically locking the piston under a pressure selected in dependence on the working position of the piston, the hydraulic locking pressure decreasing along the piston stroke against the direction of action of the external force.

2. The method of claim 1, wherein the piston is moved into the working position under the hydraulic locking pressure selected for said working position.

* * * * *